US007377760B2

(12) United States Patent
Takayanagi

(10) Patent No.: US 7,377,760 B2
(45) Date of Patent: May 27, 2008

(54) SOFT CAPSULE MANUFACTURING APPARATUS

(75) Inventor: Tetsuo Takayanagi, Tokyo (JP)

(73) Assignee: Kabushiki Kaisha Kamata, Tokyo (JP)

( * ) Notice: Subject to any disclaimer, the term of this patent is extended or adjusted under 35 U.S.C. 154(b) by 15 days.

(21) Appl. No.: 11/560,474

(22) Filed: Nov. 16, 2006

(65) Prior Publication Data

US 2007/0116790 A1 May 24, 2007

(30) Foreign Application Priority Data

Nov. 18, 2005 (JP) ..... 2005-334806

(51) Int. Cl.
*B28B 1/54* (2006.01)
*B65B 1/04* (2006.01)

(52) U.S. Cl. ..... 425/5; 425/112; 425/326.1; 425/425; 425/446; 264/4

(58) Field of Classification Search ..... 425/5, 425/112, 326.1, 425, 446; 264/4
See application file for complete search history.

(56) References Cited

U.S. PATENT DOCUMENTS 2,275,654 A * 3/1942 Ravenscroft et al. ..... 53/451
2,309,545 A * 1/1943 Scherer ..... 425/5
2,323,581 A * 7/1943 Weckesser ..... 53/454
2,339,286 A * 1/1944 Moule ..... 264/4
2,355,329 A * 8/1944 Ravenscroft et al. ..... 264/4
2,387,747 A * 10/1945 Cowley ..... 53/454
2,390,337 A * 12/1945 Spotz ..... 53/454
2,497,212 A * 2/1950 Donofrio ..... 53/443
2,568,094 A * 2/1951 Smith ..... 156/145
2,774,988 A * 12/1956 Stirn et al. ..... 425/223
4,253,812 A * 3/1981 Mackal et al. ..... 425/157
4,975,040 A * 12/1990 Kammuri et al. ..... 425/378.2
5,672,300 A * 9/1997 Schurig et al. ..... 264/4
5,735,105 A * 4/1998 Stroud et al. ..... 53/411

(Continued)

FOREIGN PATENT DOCUMENTS

GB 962 029 A1 6/1964

(Continued)

*Primary Examiner*—Yogendra N. Gupta
*Assistant Examiner*—Seyed Masoud Malekzadeh
(74) *Attorney, Agent, or Firm*—Christa Hildebrand; Norris McLaughlin & Marcus, PA

(57) ABSTRACT

In a sheet forming part 2 of a soft capsule manufacturing apparatus 1, a drum drive system 27 which forms a gelatin sheet 13, and a pickup roller drive system 28 which peels off the gelatin sheet 13 are constructed to drive separately from each other. In the drum drive system 27, a film-sheet forming drum 23 is driven by a first motor 271, while in the pickup-roller drive system 28, a pickup roller 24 is driven by a second motor 281. The first motor and the second motor are controlled in speed separately from each other, so that the film-sheet forming drum rotates at a suitable speed for forming film sheet on the peripheral surface and the pickup roller rotates at a suitable speed for peeling off the adhered film sheet on the peripheral surface of the film-sheet forming drum, whereby gelatin sheet jamming and double-rolling on the film-sheet forming drum, which would be caused by too weak peeling force of the pickup roller, and gelatin sheet damage between the pickup roller and the film-sheet forming drum, which would be caused by too strong peeling force.

5 Claims, 9 Drawing Sheets

U.S. PATENT DOCUMENTS

| | | | | |
|---|---|---|---|---|
| 5,761,886 | A | 6/1998 | Parkhideh | |
| 6,022,499 | A * | 2/2000 | Schurig et al. | 264/4 |
| 6,187,250 | B1 * | 2/2001 | Champagne | 264/495 |
| 6,260,332 | B1 | 7/2001 | Takayanagi | |
| 6,402,496 | B2 * | 6/2002 | Ishikawa et al. | 425/116 |
| 6,569,363 | B1 * | 5/2003 | Schurig et al. | 264/4 |
| 6,729,867 | B2 * | 5/2004 | Peter et al. | 425/132 |
| 6,805,818 | B2 * | 10/2004 | Schurig et al. | 264/4 |
| 2001/0006689 | A1 * | 7/2001 | Ishikawa et al. | 425/269 |
| 2005/0073066 | A1 * | 4/2005 | Victorov et al. | 264/40.1 |

FOREIGN PATENT DOCUMENTS

| | | |
|---|---|---|
| JP | 11 221267 | 8/1999 |

* cited by examiner (a)

(b)

(c)

(a)

(b)

(c)

(d)

PRIOR ART

PRIOR ART

SOFT CAPSULE MANUFACTURING APPARATUS

BACKGROUND OF THE INVENTION

1. Field of the Invention

The present invention relates to an apparatus for Manufacturing soft capsules.

2. Description of the Related Art

It is conventionally known that soft capsules, with material such as medicines charged inside capsule films, formed from animal materials such as gelatin and from vegetable materials such as starch, are in common use mainly for medical and pharmaceutical products. Such soft capsules are generally manufactured by using rotary type manufacturing apparatuses as disclosed in Japanese Patent Laid-Open No. 11-221267.

As disclosed in the above document, a rotary type manufacturing apparatus consists of a sheet forming part that forms a gelatin sheet from a gelatin material, and a capsule forming part that forms capsules from the gelatin sheet. Two gelatin sheets formed in the sheet forming part are inserted between a pair of die rolls of the capsule forming part and are heat-sealed, while, a material is filled in between the gelatin sheets. The gelatin sheets are die-cut into a capsule shape with dies on a die roll outer peripheral surface, and thus, a soft capsule charged with the material inside the gelatin film is completed.

Explaining the sheet forming part in the conventional manufacturing apparatus in more detail, a sheet forming part 50 is constructed by a spreader box 51, a film-sheet forming drum 52, and a pickup roller 53 as shown in FIG. 9.

The spreader box 51 has the function of storing a fixed amount of a raw gelatin material 11, and adhering the gelatin material 11 on the film-sheet forming drum 52 by thinly spreading it thereon. The film-sheet forming drum 52 has cooling water circulated therein and is rotatably supported, and forms a cooled and solidified gelatin sheet 13 by blowing dried cold air to the gelatin material 11 while rotating the gelatin material 11 adhered on the drum surface. The pickup roller 53 peels off the gelatin sheet 13 adhering to the film-sheet forming drum 52 and transfers the gelatin sheet 13 wound on the roller outer periphery to a capsule forming part at the subsequent step by rotation of the roller. The sheet forming parts 50 are provided by being paired at both left and right sides of the die roll, and the two gelatin sheets 13 and 13 formed by a pair of sheet forming parts 50 and 50 are transferred to the die roll.

In the sheet forming part 50 as described above, the drive system has the structure in which a drum drive system 60 which rotates the film-sheet forming drum, and a pickup roller drive system 70 which rotates a pickup roller, are provided to be linked with each other as shown in FIG. 10. Namely, in the drum drive system 60, a timing belt 64 is looped over both a pulley of a speed reducer 62 connected to a motor 61 and a drum shaft input pulley 63 at a drum shaft center, and the film-sheet forming drum 52 is rotated by transmitting the rotation of the motor 61 to the drum shaft input pulley 63 via the timing belt 64.

Meanwhile, a drive source of the pickup roller drive system 70 is the same motor 61 as the film-sheet forming drum 52, and a drum shaft output pulley 71 sharing the shaft center with the drum shaft input pulley 63, and a pickup roller input pulley 72 are connected via an idler 73. Namely, a timing belt 75 is looped over both the drum shaft output pulley 71 and an idler shaft input pulley 74 with a small diameter, and a timing belt 77 is looped over both the pickup roller input pulley 72 and an idler shaft output pulley 76 with a large diameter. Accordingly, the rotational force which is transmitted to the drum shaft via the speed reducer 62 from the motor 61 is further transmitted to the pickup roller input pulley 72 via the idler 73, and thereby rotates the pickup roller 53.

However, in the conventional manufacturing apparatus, a linking drive method which links the drum drive system 60 and the pickup roller drive system 70 as described above is adopted in the sheet forming part 50, and therefore, the following problem occurs.

From the viewpoint of enhancing production efficiency of soft capsules, it is necessary to increase the rotational speed of the pickup roller 53 to transfer the gelatin sheet 13 supplied to the die roll at a high speed, but for this purpose, the rotational frequency of the motor 61 that is the drive source has to be increased, and with this, the rotation of the film-sheet forming drum 52 is increased in speed. However, when the film-sheet forming drum 52 is rotated at a high speed, the gelatin sheet 13 adhering to the drum surface does not dry in time, and the trouble that the gelatin sheet 13 which is hardly peeled off with the pickup roller 53 is rolled in the spreader box 51 occurs.

When such a trouble occurs, operation of the apparatus is temporarily stopped to remove the gelatin sheet 13 rolled into the spreader box 51, and the rotational frequency of the motor 61 has to be decreased to restart the operation, which causes significant reduction in productivity. An additional important factor of the above described trouble is that a variety of materials including vegetable materials such as starch are applied for soft capsule film, instead of animal materials such as gelatin contained in cows, pigs and fish, in recent years. The vegetable materials require various drying time from raw liquid material to film sheets, due to their differences in viscosity and temperature at film-sheet forming process. Another factor is speedup of the rotation of the film-sheet forming drum 52, for higher productivity.

SUMMARY OF THE INVENTION

The present invention is made to solve the problem as described above, and its object is to provide a soft capsule manufacturing apparatus with excellent productivity, which eliminates a trouble of jamming and double-rolling of film sheet with safe, reliable and speedy peeling off of film sheet adhered to a film-sheet forming drum.

In order to attain the above-described object, a soft capsule manufacturing apparatus for manufacturing a soft capsule with a material inside capsule films, having a pair of die rolls which are close to and confront each other for receiving two film sheets, each die roll having capsule pockets and blades alternately disposed on the outer periphery, and a wedge disposed over the die rolls for supplying the material between the film sheets, to manufacture the capsules between the die rolls, filling the material in film-sheet pockets, each shaped in the film sheets after one of the capsule pockets by material injection from the wedge and heat-sealing and cutting off the film sheets around each one of the capsules by the blade, comprises a spreader box that stores liquid material of the film sheet, and discharges the liquid material to spread it with a predetermined width and thickness, a film-sheet forming drum that receives the liquid material spread by the spreader box around its peripheral surface to form the film sheet adhered on the surface, solidifying the liquid material through the rotation thereof, a pickup roller that peels off the film sheet adhered on the peripheral surface of the film-sheet forming drum and transfers the film sheet to the die roll, by the rotation thereof, a drum drive system that rotationally drives the film-sheet forming drum, having a first motor, a speed reducer connected to the first motor, a first timing belt wound around the output pulley of the speed reducer and the input pulley of the film-sheet forming drum, and driving the film-sheet forming drum with the first motor by way of the speed reducer and the first timing belt, and a pickup-roller drive system that rotationally drives the pickup roller, having a second motor and a second timing belt (284) wound around the output pulley of the second motor and the input pulley of the pickup roller, and driving the pickup roller with the second motor by way of the second timing belt, wherein the first motor and the second motor are controlled in speed separately from each other, so that the film-sheet forming drum rotates at a suitable speed for forming film sheet on the peripheral surface and the pickup roller rotates at a suitable speed for peeling off the adhered film sheet on the peripheral surface of the film-sheet forming drum.

In the present invention, as the material of the film sheet to be a capsule film, an animal material such as gelatin contained in, for example, cows, pigs and fish can be used, and the material is not limited to the animal materials, but vegetable materials such as starch contained in, for example, corn, or other materials can be also used.

In the soft capsule manufacturing apparatus according to the present invention, the film-sheet forming drum preferably includes a liquid circulation device that circulates constant-temperature-controlled liquid through the film-sheet forming drum, and an air blowing device (46) that blows constant-temperature-and-humidity-controlled air toward the outer peripheral surface of the film-sheet forming drum from outside.

In the soft capsule manufacturing apparatus according to the present invention, the die roll is provided with an air blowing device that blows constant-temperature-and-humidity-controlled air toward an outer peripheral surface of the die roll from below.

The present invention is, in the soft capsule manufacturing apparatus constituted of the above described construction, characterized in that nozzles in a plurality of rows corresponding to a plurality of rows of capsule pockets arranged on the outer peripheral surface of the die roll are provided on side surfaces of the wedge, and from the nozzles in a plurality of rows, the material is injected and charged into a plurality of rows of the capsule pockets of the die roll at a time.

The present invention is, in the soft capsule manufacturing apparatus constituted of the above described construction, characterized in that blades of a number of capsule pockets arranged on the outer peripheral surface of the die roll may be shared by adjacent capsule pockets.

According to the soft capsule manufacturing apparatus of the present invention, by adopting the single drive method which drives the drum drive system and the pickup roller drive system independently from each other in the sheet forming part, in order to transfer the film sheet to be supplied to the die roll at a high speed, the rotational speed of the pickup roller, the die roll speed, and the mangle roller speed only have to be increased with the rotational speed of the film-sheet forming drum kept as it is, whereby the film sheet can be reliably peeled off from the film-sheet forming drum by the pickup roller, and the trouble of jamming and double-rolling the sheet in the spreader box is eliminated to make a stable high-speed operation possible.

Since the drum drive system and the pickup roller drive system are provided independently from each other, it becomes possible to set the rotational speed of the film-sheet forming drum and the rotational speed of the pickup roller respectively at individual optimum values in consideration of the problems of viscosity, temperature and drying degree due to difference in material of the film sheet of which variety increases in recent years and various kinds of conditions such as drive timing of the plunger pump for supplying a material and the rotational speed of the die roll, and a fine operation control with high degree of setting freedom can be realized.

The liquid circulation device that circulates a constant temperature liquid controlled in temperature inside the drum, and an air blowing device that blows air controlled in temperature and humidity toward a drum outer peripheral surface from outside the drum are included to keep the temperature of the film-sheet forming drum at a constant temperature, and to promote drying of the film sheet adhered on the outer peripheral surface of the film-sheet forming drum. Thereby, the temperature control in the wide range becomes possible in accordance with the characteristic of the material of the film sheet, and forming of the film sheets made of various kinds of materials can be flexibly dealt with.

The air blowing device that blows air controlled in temperature and humidity toward an outer peripheral surface of the die roll from below the die roll is included, and air is blown to the soft capsules and the remaining sheet immediately after passing between the die rolls to reduce adhesiveness of them instantaneously. Thereby, the phenomenon that the soft capsules after die-cut adhere to each other again, a so-called avec phenomenon can be prevented even if the heat seal temperature is set to be high, and they are smoothly peeled off from the die rolls to be able to avoid the trouble of the remaining sheet winding around the die rolls, as a result of which, the high-speed operation of the die rolls is made possible.

The double injection mechanism in which nozzles in a plurality of rows corresponding to a plurality of rows of capsule pockets arranged on the outer peripheral surface of the die roll are provided on side surfaces of the wedge, and from the nozzles in a plurality of rows, the material is injected and charged into the capsule pockets of a plurality of rows of the die roll at a time is adopted. Thereby, the rotational speed of the die rolls can be increased, even though the drive speed of the plunger pump controlling the supply timing of the material remains slow, and the number of soft capsules which are manufactured per unit hour can be remarkably increased. In addition, since the drive speed of the plunger pump may remain slow, charge accuracy of the material is enhanced to contribute to improvement in quality of the soft capsules, and since the mechanical burden on the apparatus decreases, the service life of the apparatus can be increased.

The blades of a number of capsule pockets arranged on the outer peripheral surface of the die roll are shared by adjacent capsule pockets. Thereby, the number of capsule pockets of the entire die roll increases, and the number of soft capsules manufactured per one rotation of the die roll can be remarkably increased. Therefore, production can be increased without changing the size of the die roll, and thereby, the apparatus can be made compact, in addition to which, the cost reduction of the entire apparatus can be achieved. Since a useless gap does not exist among the capsule pockets, the amount of the remaining sheet after the soft capsules are cut out can be remarkably reduced to lead to saving of the material cost, and the trouble of the remaining sheet winding around the die roll is eliminated to make a stable high-speed operation possible.

DETAILED DESCRIPTION OF THE PREFERRED EMBODIMENTS

Figure 1:
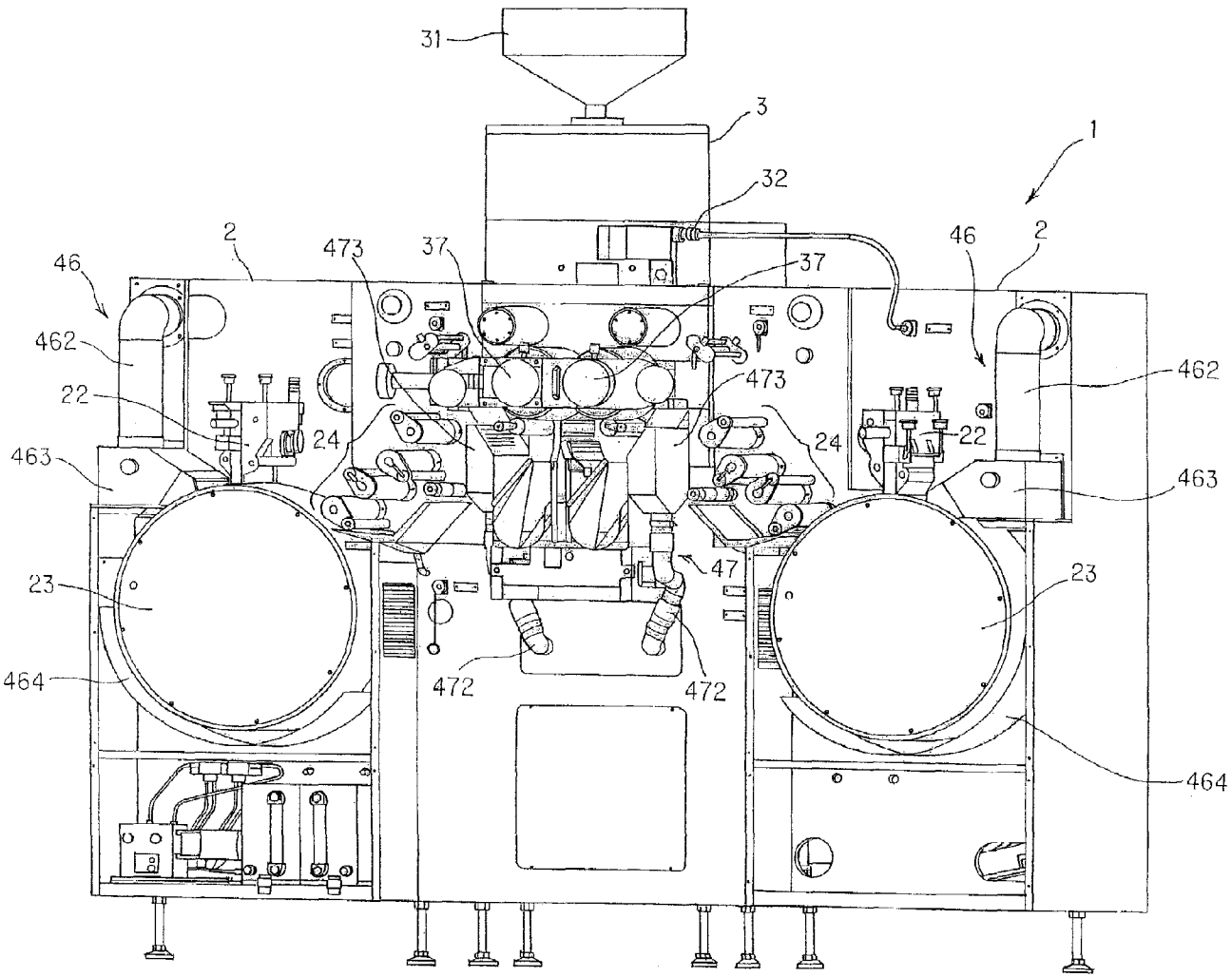
FIG. 1 is a plane view of a soft capsule manufacturing apparatus of the present invention seen from a front side.
Figure 3:
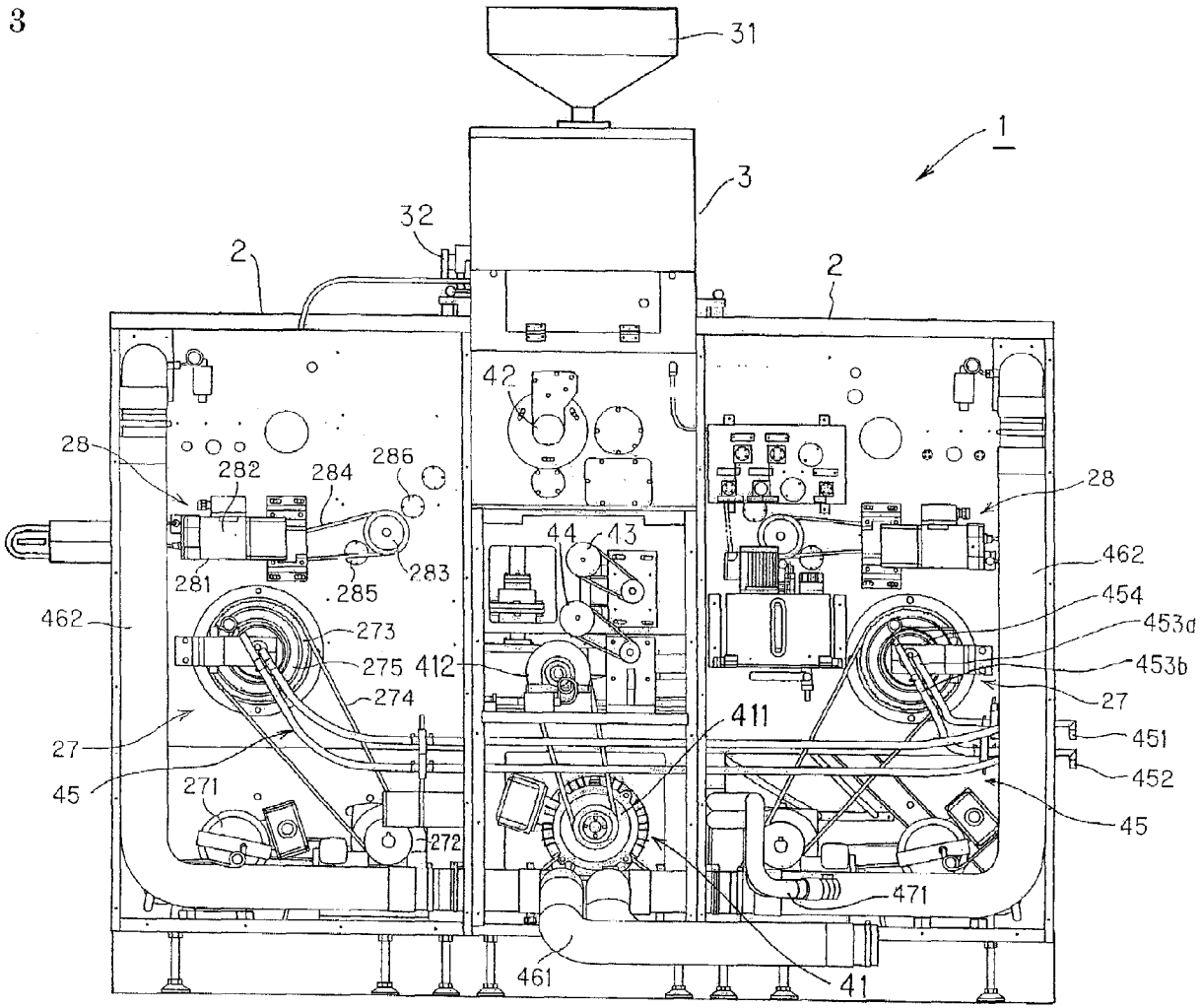
FIG. 3 is a plane view of a drive system of the same apparatus seen from a rear side.
Figure 4:
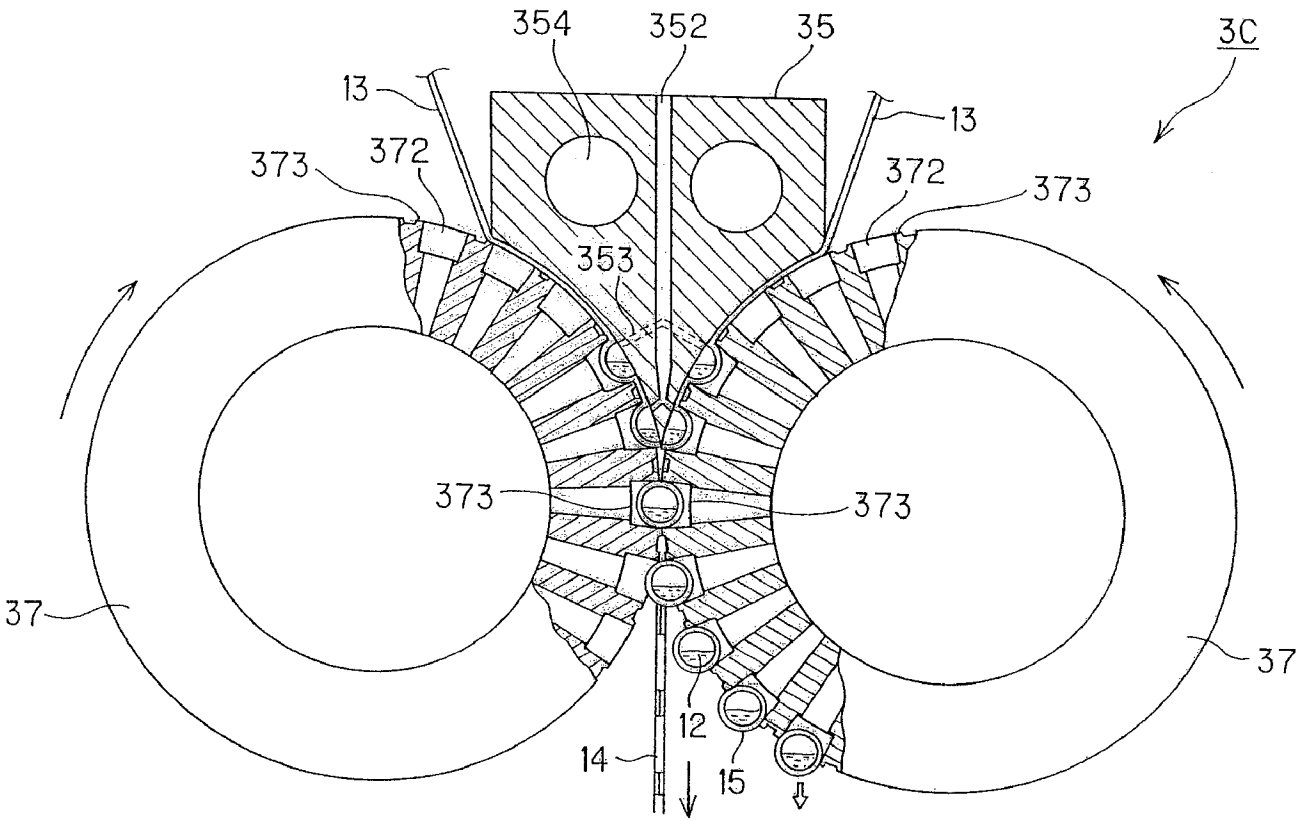
FIG. 4 is an enlarged sectional view showing a heat seal part of the same apparatus.
Figure 5:
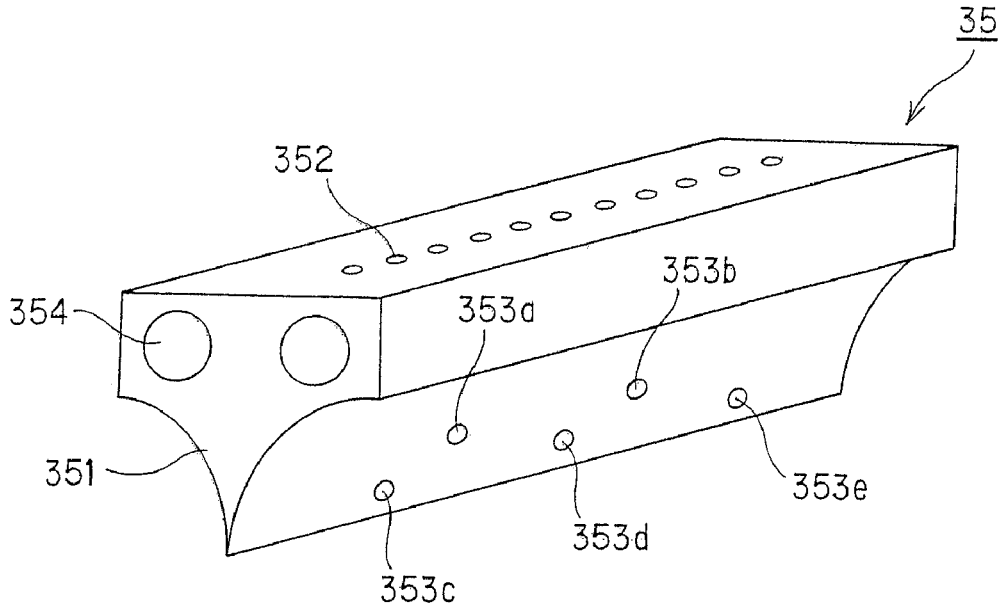
FIG. 5 is an enlarged perspective view showing a wedge of the same apparatus.
Figure 6:
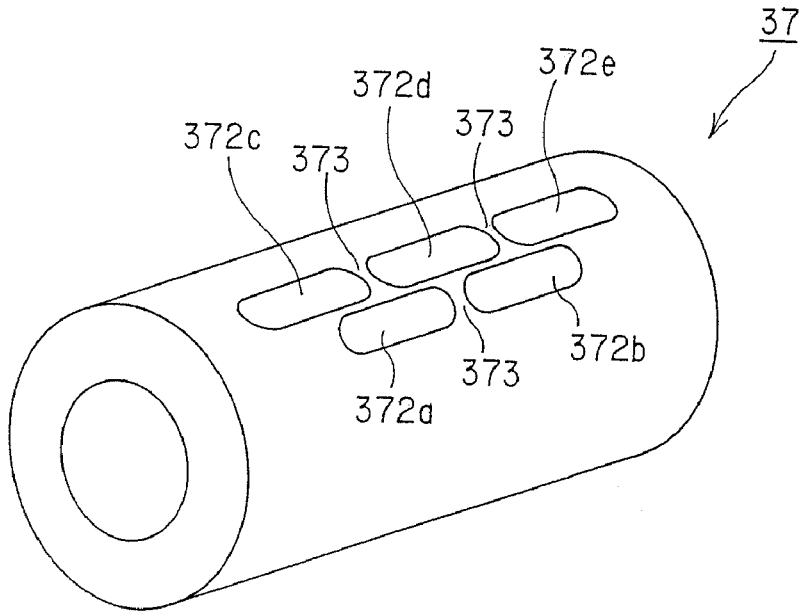
FIG. 6 is an enlarged perspective view showing a die roll of the same apparatus.
Figure 7:
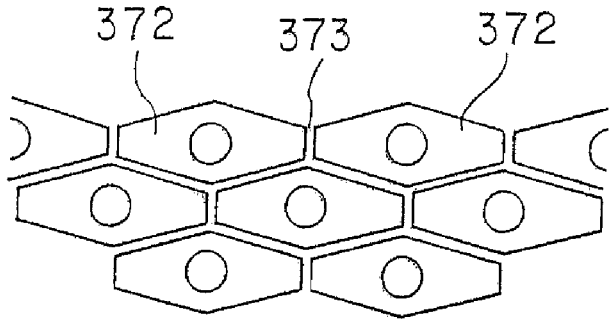
FIGS. 7A to 7C are schematic views showing examples of the shape of capsule pockets in the die roll of the same apparatus.
Figure 7:
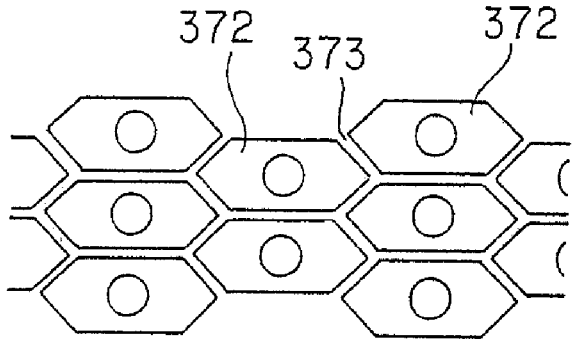
Figure 7:
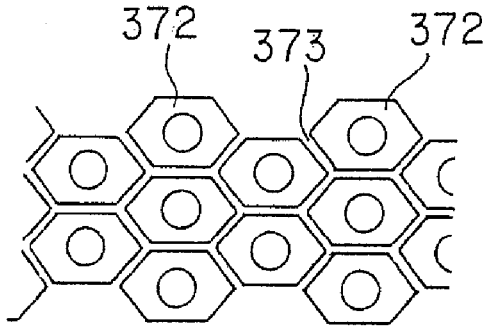
Figure 8:
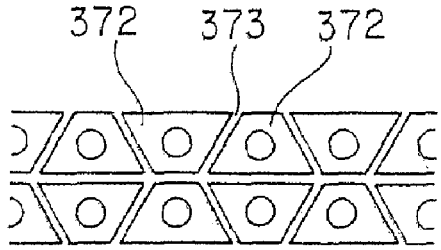
FIGS. 8A to 8D are schematic views showing other examples of the shape of the capsule pockets in the die roll of the same apparatus.
Figure 8:
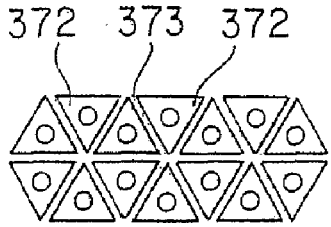
Figure 8:
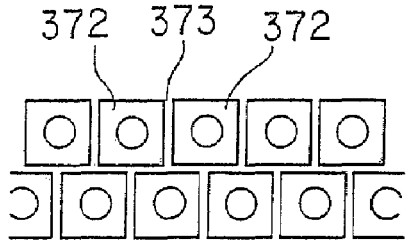
Figure 8:
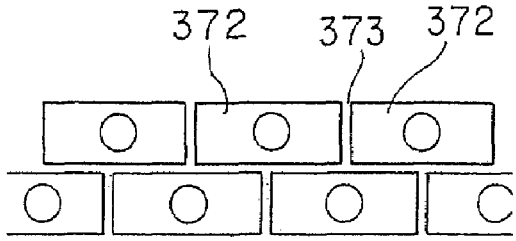
Figure 9:
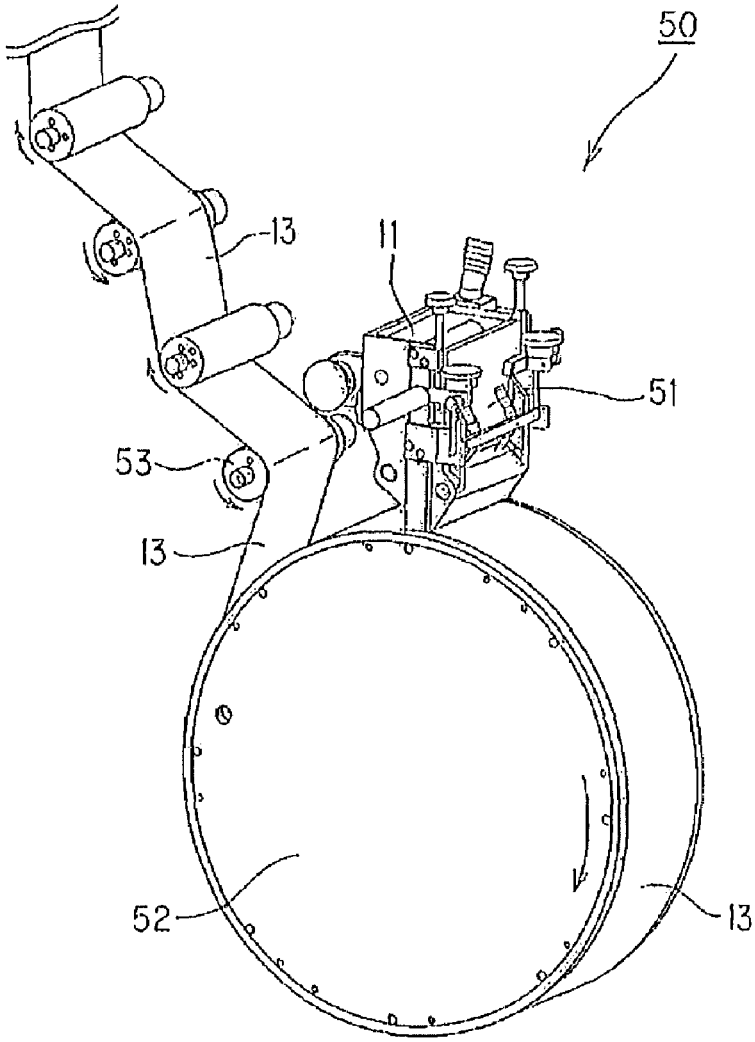
FIG. 9 is an enlarged perspective view showing a sheet forming part of a conventional soft capsule manufacturing apparatus.
Figure 10:
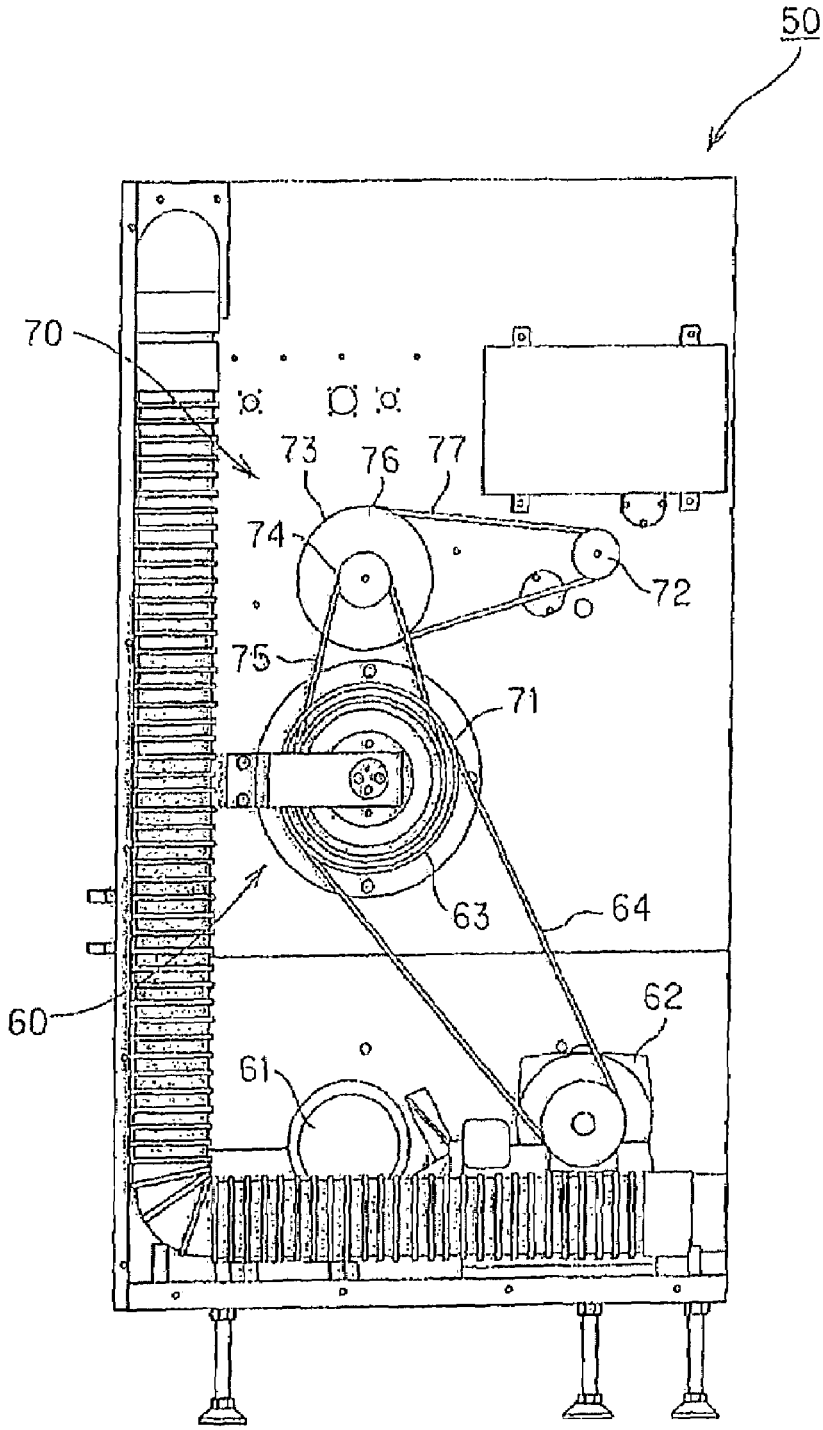
FIG. 10 is a plane view of a drive system of the same apparatus seen from the rear side.

A preferred embodiment of the present invention will now be described with reference to the attached drawings. FIG. 1 is a plane view of a soft capsule manufacturing apparatus of the present invention seen from a front side, FIG. 2 is an exploded perspective view showing an internal structure of the same apparatus, FIG. 3 is a plane view of a drive system of the same apparatus seen from a rear side, FIG. 4 is an enlarged sectional view showing a capsule forming part of the same apparatus, FIG. 5 is an enlarged perspective view showing a wedge of the same apparatus, FIG. 6 is an enlarged perspective view showing a die roll of the same apparatus, FIGS. 7A to 7C are schematic views showing examples of the shape of a capsule pockets in the die roll of the same apparatus, and FIGS. 8A to 8D are schematic views showing other examples of the shape of the capsule pockets in the die roll of the same apparatus.

In the following embodiment, an example using an animal material made of gelatin and the like as a material of a film sheet to be a capsule film is described, but the present invention is not limited to this, and vegetable materials made of starch and the like and the other materials can be used.

Figure 2:
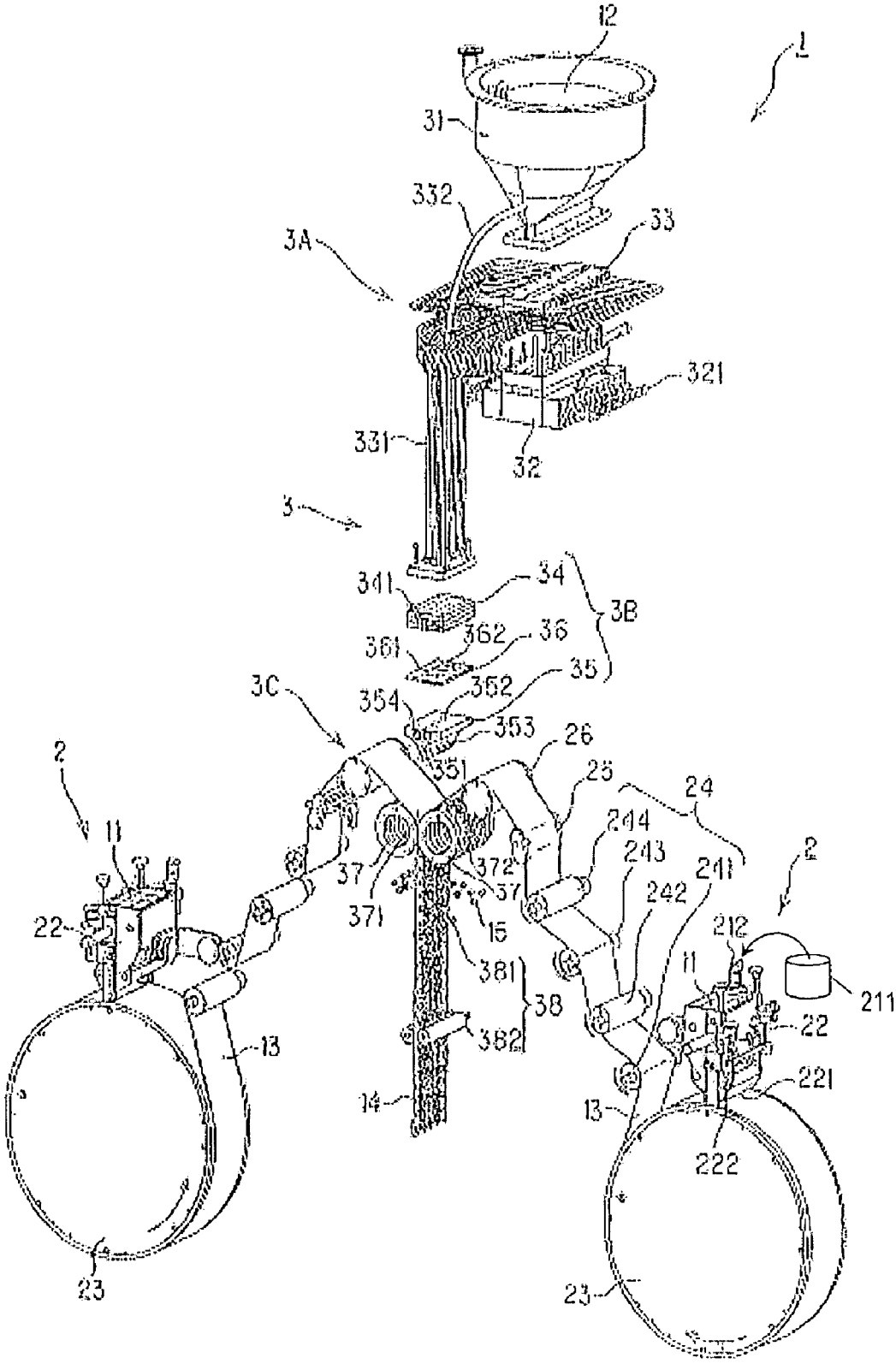
FIG. 2 is an exploded perspective view showing an internal structure of the same apparatus.

As shown in FIGS. 1 and 2, a soft capsule manufacturing apparatus 1 of the present invention is constituted of a sheet forming part 2 and a capsule forming part 3. In the sheet forming part 2, two film sheets (gelatin sheets) 13 and 13 are formed from a raw material (gelatin material) 11. In the capsule forming part 3, the gelatin sheets 13 and 13 are sealed by heat and at the same time, a content material 12 is filled in between the sheets and they are die-cut into a capsule shape. Thereby, a soft capsule 15 with the material 12 filled in the capsule film (gelatin film) is manufactured.

The structure of the sheet forming part 2 will be described first. The sheet forming part 2 is a mechanical part for forming gelatin to be the film of the soft capsule 15 into a continuous sheet shape, and is constructed by a material supply part (gelatin supply part) 21, a spreader box 22, a film-sheet forming drum 23, and a pickup roller 24.

The gelatin supply part 21 is constituted of a dispensing tank 211 and a material hose (gelatin hose) 212, so that the gelatin material 11 extracted from various kinds of raw materials such as, for example, cows, pigs and fish and purified is stored in the tank 211, and the gelatin material 11 is transferred to the spreader box 22 by the gelatin hose 212. In order to prevent the gelatin material 11 from being solidified during transfer, the gelatin hose 212 is adjusted in temperature by a heater and a sensor (not shown).

The spreader box 22 has the function of storing a fixed amount of the gelatin material 11 transferred from the gelatin hose 212, and thinly spreading the gelatin material 11 on the film-sheet forming drum 23. The gelatin material 11 stored inside the spreader box 22 is discharged from a long and narrow gate 221 opened at a bottom portion of the box, and is adhered on the surface of the film-sheet forming drum 23 by being spread to a predetermined width and thickness. A heater 222 and a sensor are mounted on the spreader box 22, so that the heater 222 heats the box to keep it at a predetermined temperature to maintain the sol state of the gelatin material 11 stored inside the box.

The film-sheet forming drum 23 is installed directly under the spreader box 22, and is for solidifying the gelatin material 11 discharged from the gate 221. The film-sheet forming drum 23 is rotatably supported by a drum drive system 27 that will be described later, and the gelatin material 11 adhered on the drum surface is cooled and gelatinized while substantially going around the outer periphery of the drum, whereby the gelatin sheet 13 continuing in a band shape with the predetermined width and thickness is formed. The film-sheet forming drum 23 of this embodiment forms the film sheet 13 by using both a drum-part liquid circulation device 45 and a drum-part air blowing device 46 as follows.

The drum-part liquid circulation device 45 is constituted of a constant temperature liquid supply port 451, a constant temperature liquid discharge port 452, constant temperature liquid pipes 453*a* and 453*b*, and a constant temperature liquid pipe 454. A constant temperature liquid such as oil and water controlled in temperature is led inside the drum via the one constant temperature liquid pipe 453*a* from the constant temperature liquid supply port 451. As shown in FIG. 3, the structure of the interior of the drum is such that the shaft has a double structure, the constant temperature liquid pipe 454 which does not rotate is placed between the shafts, and the constant temperature liquid controlled at a constant temperature circulates inside the drum through the pipe. The constant temperature liquid passing through the constant temperature liquid pipe 454 is discharged outside the apparatus from the constant temperature liquid discharge port 452 via the other constant temperature liquid pipe 453*b*. By circulating the constant temperature liquid controlled in temperature inside the film-sheet forming drum 23 in the drum-part liquid circulation device 45 like this, the temperature of the film-sheet forming drum 23 is kept at a constant temperature.

The drum-part air blowing device 46 is constituted of an air supply port 461, an air pipe 462 and an air blowout port 463. Plant equipment is placed outside the apparatus, dry air controlled in temperature and humidity by the plant equipment is taken in from the air supply port 461 via the air pipe 462, and is blown toward the drum surface from the air blowout port 463 provided outside the drum. A movable blade (not shown) is provided inside the air blowout port 463 so as to be able to control the direction of the dry air blown to the drum surface. A duct cover 464 is provided outside the film-sheet forming drum 23 to surround the outer periphery of the drum, so as to restrict the direction of the dry air and prevent entry of dust to the drum surface from the outside. By blowing the dry air toward the gelatin sheet 13 on the drum surface with the drum-part air blowing device 46 like this, moisture contained in the gelatin is evaporated to promote drying of the gelatin sheet 13 to enhance adhesiveness at the time of heat seal.

As the material of the film, animal materials such as gelatin contained in cows and pigs are the mainstream, but when gelatin contained in fish, for example, is used as the other materials than them, it has to be controlled at a lower temperature as compared with that of cows and pigs, and when vegetable materials such as starch contained in corn is used, it has to be controlled at a higher temperature as compared with cows and pigs on the other hand. According to the structure which only circulates cooling water inside the drum as a conventional ordinary film-sheet forming drum, even if the film sheets can be formed from the materials composed of such special materials, heat seal becomes incomplete, and soft capsules cannot be formed. On the other hand, the film-sheet forming drum 23 of this embodiment uses both the drum-part liquid circulation device 45 and the drum-part air blowing device 46 as described above. Therefore, the film-sheet forming drum 23 can be not only cooled but also heated, and the temperature control in a wide range in accordance with the characteristics of the film materials can be performed. Therefore, according to the film-sheet forming drum 23, formation of the film sheets 13 made of various kinds of materials can be flexibly dealt with.

The pickup roller 24 is placed at the position in which the gelatin sheet 13 formed by the film-sheet forming drum 23 substantially finishes a rotation, and is for peeling off the gelatin sheet 13 adhering to the outer peripheral surface of the drum and supplying it to the capsule forming part 3 at the subsequent stage. In the pickup roller 24, four rollers 241 to 244 are alternately rotate reversely by the drive system 28 which will be described later. The gelatin sheet 13 peeled off from the film-sheet forming drum 23 is wound on the rollers, and passes the four rollers in zigzags to reach a sheet guide 25. Further, the gelatin sheet 13 which is adjusted in position by the sheet guide 25 is supplied to a die roll 37 of the capsule forming part 3 via a ribbon roller 26.

The ribbon roller 26, which is a roller for accurately guiding the transferred gelatin sheet 13 to the die roll 37, is adhered with Teflon (trade name) on the outer peripheral surface of the roller, so as to be able to transfer the gelatin sheet 13 smoothly.

The first roller 241 which is located at the lowest end of the four pickup rollers, has roulette work applied to the roller outer peripheral surface to make it easy to peel off the gelatin sheet 13 from the film-sheet forming drum 23, and gripping force for holding the gelatin sheet 13 is enhanced. The second roller 242 and the third roller 243 which are located in the middle coat oil from the roller outer peripheral surfaces to a back surface of the gelatin sheet 13, and subsequently to a front surface in order to make slide of the gelatin sheet 13 sandwiched by the wedge 35 and the die roll 37 smooth at the time of capsule formation. The fourth roller 24 located at the uppermost end functions as a roller to make the coating area of oil in the third roller 243 the same as that of the second roller 242.

Explaining the drive system of the sheet forming part 2 here, this embodiment is characterized by adopting an independent drive method which independently drives the drum drive system 27 for rotating the film-sheet forming drum 23 and the drive system 28 for rotating the pickup roller 24 from each other as shown in FIG. 3.

The drum drive system 27 has the structure in which a timing belt 274 is wound around both a pulley of a speed reducer 272 connected to a first motor 271 and a drum shaft input pulley 273 at a shaft center of the film-sheet forming drum 23. Thereby, rotational torque of the first motor 271 becomes large by reducing the rotational frequency with the speed reducer 272, the rotational force is transmitted to the drum shaft input pulley 273 via the timing belt 274, and rotationally drives the film-sheet forming drum 23 independently.

Meanwhile, a drive source of the pickup roller drive system 28 is a second motor 281 which separately drives from the first motor 271 of the film-sheet forming drum 23. A timing belt 284 is wound round both a pulley 282 for motor mounted to an output shaft of the second motor 281 and a pickup roller input pulley 283. Therefore, when the second motor 281 is driven, the rotating force is directly transmitted to the pickup roller input pulley 283 via the timing belt 284, and thereby, the pickup roller 24 is rotationally driven independently.

The pickup roller input pulley 283 is mounted to a center axis of the second roller 242, and by simultaneously rotating the pulleys 285 and 286 of the first and the third rollers meshed with the pulley 283 reversely from each other, the film-sheet forming drum 23 and the first roller 241 are inversely driven from each other, and four rollers 241 to 244 are alternately driven inversely. By separating drive of the drum drive system 27 and that of the pickup roller drive system 28, an idler 73 and a drum shaft output pulley 71 which conventionally connect both the systems are not required, and a sleeve 275 which closes a gap after removing the drum shaft output pulley 71 is mounted to a drum shaft.

In this embodiment, a single drive method which drives the drum drive system 27 and the pickup roller drive system 28 independently from each other in the sheet forming part 2 is adopted like this, and thereby, when the gelatin sheet 13 to be supplied to the capsule forming part 3 is transferred at a high speed, the pickup roller 24, the die roll 37 and a mangle roller 382 are rotated at a high speed by increasing the rotational frequency of the second motor 281 in the pickup roller drive system 28. Thereby, the drum drive system 27 maybe operated at a speed as it is, and the rotational speed of the film-sheet forming drum 23 does not have to be increased. Therefore, drying time for the gelatin sheet 13 adhering to the drum surface can be sufficiently secured. Accordingly, the gelatin sheet 13 can be reliably peeled off from the film-sheet forming drum 23 by the pickup roller 24, and the trouble of jamming and double-rolling the sheet into the spreader box 22 is eliminated, thus making a stable and high-speed operation possible.

Since the drum drive system 27 and the pickup roller drive system 28 are independent from each other, it becomes possible to set the rotational speed of the film-sheet forming drum 23 and the rotational speed of the pickup roller 24 respectively at individual optimum values in consideration of various kinds of conditions such as drying time differing in accordance with the materials of film sheets which have been varied in recent years, or the drive timing of a plunger pump 32 which will be described later and the rotational speed of the die roll 37, and a fine operation control with high degree of setting freedom can be realized.

The sheet forming part 2 constituted of the gelatin supply part 21, the spreader box 22, the film-sheet forming drum 23, and the pickup roller 24, the drum drive system 27 and the pickup roller drive system 28, the drum-part liquid circulation device 45 and the drum-part air blowing device 46 are paired and installed at both left and right sides with the capsule forming part 3 as a center as shown in FIGS. 2 and 3, and thereby, the two gelatin sheets 13 and 13 formed with a pair of sheet forming parts 2 and 2 are transferred to the capsule forming part 3.

Next, the structure of the capsule forming part 3 will be described. As shown in FIG. 2, the capsule forming part 3 is the mechanical part for forming a soft capsule 15 by filling the material 12 such as a medicine in between the two gelatin sheets 13 and 13 which are transferred from the aforementioned sheet forming part 2, and is constructed by a material supply part 3A, a segment part 3B and a heat seal part 3C.

The material supply part 3A is constituted of a hopper 31, the plunger pump 32 and a tube assembly 33, and is for supplying the material 12 stored in the hopper 31 to the segment part 3B in a predetermined timing by drive of the plunger pump 32. The plunger pump 32 includes a plurality of plunger pins 321 and 321 which perform advancing and retreating operations in the cylinder, and controls the supply timing of the material 12 by opening and closing valves by the valves, which receive pressure of the plunger pins 321, separating from and contacting a seat surface.

The tube assembly 33 has the same number of supply tubes 331 and 331 as that of the above described plunger pins 321 between two upper and lower plates, and a return tube 332 which returns the line of a tube not in use to the hopper 31, and the material 12 of which supply is controlled by the plunger pump 32 is supplied to the segment part 3B via the supply tubes 331 from the hopper 31.

The segment part 3B has the function of charging the material 12 supplied from the material supply part 3A between the two gelatin sheets 13 and 13, and is constituted of a shutoff valve 34, a wedge 35 and a distributor 36 interposed between them.

The shutoff valve 34 can control start and stoppage of material supply by opening and closing the valve by utilizing the slide mechanism by operation of a lever 341, and can return all the material 12 supplied from the tube assembly 33 to the hopper 31 with the return tube 332.

The wedge 35 is for filling the material 12 in between the gelatin sheets 13 and 13 supplied to between a pair of die rolls 37 and 37, and is formed into a wedge shape having a curved protruded part 351 fitted in a curved recessed part 371 over the outer periphery of the die roll 37, and supply holes 352 aligned in a row are opened on a top surface of the curved protruded part 351, and nozzles 353 for injecting the material 12 are opened on a side surface of the curved protruded part 351 to correspond to the supply holes 352. A heater 354 and a sensor are contained in a center of the wedge 35, and by heating the wedge 35 with the heater 354, heat required at the time of heat seal is transmitted to the gelatin sheet 13.

The distributor 36 is for dispersing the material 12 passing through the shutoff valve 34 to supply it to the wedge 35, and supply holes 361 disposed to disperse corresponding to the supply holes 352 of the wedge 35, and a groove 362 for returning the unused material 12 to the return tube 332 are worked thereon.

The heat seal part 3C is the part which heat-seals the two gelatin sheets 13 and 13 transferred from the sheet forming parts 2 and 2 at both the left and right sides, and at the same time, die-cuts them into a capsule shape to form the soft capsule 15. A pair of die rolls 37 and 37 which rotate reversely from each other are disposed to be opposed to each other in close proximity to each other, and the curved recessed part 371 for the wedge 35 to be fitted in is defined and formed over the outer peripheries of both the rollers. A plurality of capsule pockets 372 and 372 are arranged in rows and opened on the outer peripheral surface of the die roll 37 as dies for die-cutting the gelatin sheet 13 into the capsule shape, and blades 373 are formed between the respective adjacent capsule pockets 372 and 372.

As shown by being enlarged in FIG. 4, in the heat seal part 3C, the two gelatin sheets 13 and 13 are supplied between a pair of die rolls 37 and 37, and the wedge 35 is fitted in the position over them, and the material 12 is injected from the nozzles 353 on the side surface, whereby the material 12 is filled in between the two gelatin sheets 13 and 13 pinched between the die rolls 37 and 37. At the same time as this, the wedge 35 is heated with the heater 354, and melts the gelatin sheet 13 with the heat to enhance adhesiveness, and heat seal is performed with the pressure when the gelatin sheet 13 passing through the narrowest space between the rollers. Further, the blades 373 and 373 of the die rolls at both the left and right sides are meshed with each other at this time, and thereby the gelatin sheet 13 is cut into the capsule shape. A chute assembly 38 constituted of a strip roller 381 and the mangle roller 382 are disposed as shown in FIG. 2 at a position below the die rolls 37 where capsule formation is completed like this. In the chute assembly 38, a remaining gelatin sheet (remaining sheet) 14 after cutting out the soft capsules 15 is pulled downward by rotating the mangle roller 382, the soft capsules 15 remaining on the sheet side is separated from the remaining sheet 14 by rotation of the strip roller 381, and only the soft capsules 15 are collected via a chute disposed at a front. The rotational speed of the mangle roller 382 is adjusted so that the remaining sheet 14 is not rolled into the die roll 37 and the remaining sheet 14 is not torn off halfway.

The heat seal part 3C is further provided with a chute-part air blowing device 47. The chute-part air blowing device 47 is constituted of an air supply port 471, an air pipe 472 and an air blowout port 473. As in the above described drum-part air blowing device 46, dry air controlled in temperature and humidity by the plant equipment outside the apparatus is taken in via the air pipe 472 from the air supply port 471, and is uniformly blown toward the outer peripheral surfaces of a pair of die rolls 37 and 37 from the air blowout ports 473 and 473 at both sides provided below the die rolls. By blowing dry air toward the die roll 37 from below in the chute-part air blowing device 47, adhesiveness of the soft capsule 15 and the remaining sheet 14 just after passing between the die rolls 37 and 37 at the time of high-speed operation is instantly reduced, and the soft capsules 15 and 15 after die-cut can be prevented from adhering to each other again, at the same time as which, the soft capsules 15 can be smoothly peeled off from the die roll 37, thus making it possible to avoid the trouble that the remaining sheet 14 winds around the die roll 37. The chute-part air blowing device 47 is provided by being paired at both the left and right sides correspondingly to a pair of die rolls 37 and 37.

The drive system of the heat seal part 3C is driven independently from the drum drive system 27 and the pickup roller drive system 28 as shown in FIG. 3. Namely, the heat seal part 3C has a die roll drive system 41 independent and constituted of a motor 411 and a speed reducer 412 as the drum drive system 27, and drives the die rolls 37, the ribbon roller 26, and the plunger pump 32 disposed at the upper portion with a gear mechanism 42 manually operated for fine adjustment of the positions of the left and right die rolls 37 and the like interposed therebetween. A chute-assembly drive system 43 which drives the chute assembly 38 located in the center, and a mangle-roller drive system 44 which drives the mangle roller 382 are rotationally driven by an internal motor not shown. Therefore, the five drive systems in total that are (1) the drum drive system 27, (2) the pickup roller drive system 28, (3) the die roll drive system 41, (4) the chute-assembly drive system 43, and (5) the mangle-roller drive system 44 exist in this apparatus. By dividing the drive system for the respective regions where the gelatin sheet 13 passes like this, the problem of the gelatin sheet 13 which is likely to occur to each of the regions can be handled.

The basic structure of the soft capsule manufacturing apparatus 1 according to the present invention is described above, and in this embodiment, especially from the viewpoint of enhancing the manufacturing efficiency, a double injection mechanism in which nozzles 353 are provided in a plurality of rows on the wedge 35 constituting the segment part 3B is adopted as described as follows. Namely, as shown by being enlarged in FIG. 5, on the right side surface of the curved protruded part 351 in the wedge 35, nozzles 353 in two upper and lower rows are provided to be aligned in the longitudinal direction, and two nozzles 353*a* and 353*b* in the upper row, and three nozzles 353*c*, 353*d* and 353*e* in the lower row are alternately disposed respectively. The nozzles 353*a* to 353*e* in the two upper and lower rows are similarly provided on the left side surface on the opposite side.

Accordingly, by one drive of the plunger pump 32, the material 12 can be filled into the capsule pockets 372 in two rows of the die roll 37 from the nozzles 353 in the two rows on one side of the wedge 35 at one time. Therefore, even though the drive speed of the plunger pump 32 remains slow, the rotational speed of the die roll 37 results in doubling, and the number of soft capsules 15 which can be manufactured per unit hour can be doubled, whereby production can be remarkably boosted. Since in addition, the drive speed of the plunger pump 32 may remain to be slow, charging accuracy of the material 12 is enhanced, which leads to improvement in quality of the soft capsules 15, and since a mechanical burden on the apparatus is reduced, the apparatus with high reliability capable of withstanding use for a long time can be provided.

In order to further enhance the productivity, in the die roll 37, the blade 373 is shared by the adjacent capsule pockets 372 and 372, and thereby, the roller having the number of pockets at high density can be constructed. Namely, as shown by being enlarged in FIG. 6, on the outer peripheral surface of the die roll 37 on the right side, the combination of two elliptic capsule pockets 372*a* and 372*b* arranged equidistantly in the axial direction and three elliptic capsule pockets 372*c*, 372*d* and 372*e* arranged equidistantly in the axial direction is provided correspondingly to the positions of the nozzles 353*a* to 353*e* formed on the above described wedge 35. Though not shown, this combination is provided continuously in the circumferential direction of the die roll 37. The capsule pockets 372*a* to 372*e* of the die roll 37 occupy the positions with respect to the material 12 injected from the nozzles 353*a* to 353*e* of the wedge 35 while rotating. The blade 373 is shared by the adjacent capsule pockets 372 and 372, and therefore, a useless gap does not exist between the capsule pockets 372 and 372. The capsule pockets 372 at high density are similarly provided at the die roll 37 at the left side.

Accordingly, the number of capsule pockets of the entire die roll 37 remarkably increases, and the number of soft capsules 15 manufactured per one rotation of the die roll 37 can be increased. Since production can be increased without increasing the length and diameter of the die roll 37 as a result, the apparatus can be made compact, and cost of the entire apparatus can be reduced at the same time. Further, since the useless gap does not exist between the capsule pockets 372 and 372, the amount of the remaining sheet 14 after the soft capsules 15 are cut out can be significantly reduced, which results in saving of the material cost, and the trouble of the remaining sheet 14 becoming a net to wind around the die roll 37 is eliminated to make a stable operation possible.

The shape of the capsule pocket 372 provided on the outer peripheral surface of the die roll 37 is not limited to an elliptic shape shown in FIG. 6, but various kinds of modification examples can be considered. As shown in, for example, FIGS. 7A to 7C, various kinds of hexagonal pockets may be arranged, or trapezoidal, triangular, square or rectangular pockets as shown in FIGS. 8A to 8D can be arranged other than these hexagonal pockets, and the shape of the capsule pocket 372 may be properly selected in accordance with the product shape of the soft capsule 15 to be formed.

Summing up the above description, by adopting the characteristic structures cited in the following descriptions (1) to (4) in the soft capsule manufacturing apparatus 1, a significantly high-speed operation as compared with the conventional apparatus becomes possible, and as a result, remarkable increase in production of the soft capsule 15 can be realized.

(1) Double Injection Mechanism

By injecting and charging the material 12 at one time to the capsule pockets 372 in a plurality of rows arranged on the outer peripheral surface of the die roll 37 from the nozzles 353 in a plurality of rows on the side surface of the wedge 35, the rotational speed of the die roll 37 can be increased, even if the drive speed of the plunger pump 32, which has limitation due to the mechanical structure, remains slow, and the number of soft capsules 15 which are manufactured per unit hour can be increased.

(2) Independent Drive of the Drum Drive System and Pickup Roller Drive System

If the rotational speed of the pickup roller 24, the die roll 37 and the mangle roller 382 is increased without increasing the rotational speed of the film-sheet forming drum 23 when the film sheet 13 supplied to the die roll 37 is transferred at a high speed, the film sheet 13 in close contact with the film-sheet forming drum 23 can be reliably peeled off by the pickup roller 24 independently rotating at a high speed. Therefore, the trouble of jamming and double-rolling the film sheet 13 into the spreader box 22 is eliminated, and the film sheet 13 withstands the high speed operation.

(3) Use Both of the Drum-part Liquid Circulation Device and the Drum-part Air Blowing Device The temperature of the film-sheet forming drum 23 is kept at a constant temperature by circulating the constant temperature liquid controlled in temperature inside the film-sheet forming drum 23, and the dry air controlled in temperature and humidity is blown to the outer peripheral surface of the film-sheet forming drum 23 to promote drying of the film sheet 13. Thereby, the temperature control in the wide range becomes possible in accordance with the characteristic of the material of the film sheet 13, and forming of the film sheets made of various kinds of materials can be flexibly dealt with.

(4) Chute-part Air Blowing Device

By uniformly blowing dry air controlled in temperature and humidity toward the outer peripheral surface of the die roll 37 from below the die roll 37, adhesiveness of the soft capsule 15 and the remaining sheet 14 immediately after passing between the die rolls 37 and 37 at the time of high speed forming is instantly reduced to be able to prevent the phenomenon that the soft capsules 15 and 15 after die-cut adhere to each other again, and they are smoothly peeled off from the die roll 37 to be able to avoid the trouble of the remaining sheet 14 winding around the die roll 37, thus making the high-speed operation of the die roll 37 possible.

What is claimed is:

1. An apparatus for manufacturing soft capsule charged with a material (12) inside capsule films, having a pair of die rolls (37, 37) which are close to and confront each other for receiving two film sheets (13, 13), each die roll having a plurality of capsule pockets (372) and blades (373) alternately disposed on the outer periphery, and a wedge (35) disposed over the die rolls for supplying the material between the film sheets, to manufacture the capsules (15) between the die rolls, filling the material in film-sheet pockets, each shaped in the film sheets after one of the capsule pockets by material injection from the wedge and heat-sealing and cutting off the film sheets around each one of the capsules by the blade, comprising:

a spreader box (22) for storing liquid material (11) for the film sheet, and discharges the liquid material to spread it with a predetermined width and thickness;

a film-sheet forming drum (23) for receiving the liquid material spread by the spreader box around a peripheral surface of the drum to form the film sheet adhered on the surface, solidifying the liquid material through the rotation thereof;

a pickup roller (24) for peeling off the film sheet adhered on the peripheral surface of the film-sheet forming drum and transfers the film sheet to the die roll, by the rotation thereof, the pickup roller is formed on the outer peripheral surface to include roulette work;

a drum drive system (27) that rotationally drives the film-sheet forming drum, having a first motor (271), a speed reducer (272) connected to the first motor, a first timing belt (274) wound around an output pulley of the speed reducer and an input pulley of the film-sheet forming drum, and driving the film-sheet forming drum with the first motor by way of the speed reducer and the first timing belt; and a pickup-roller drive system (28) that rotationally drives the pickup roller, having a second motor (281) and a second timing belt (284) wound around an output pulley of the second motor and an input pulley of the pickup roller, and driving the pickup roller with the second motor by way of the second timing belt;

wherein the first motor and the second motor are controlled in speed separately from each other, so that the film-sheet forming drum rotates at a suitable speed for forming film sheet on the peripheral surface and the pickup roller rotates at a suitable speed for peeling off the adhered film sheet on the peripheral surface of the film-sheet forming drum and further comprises a die roll drive system (41) constituted of a motor (411) and a speed reducer (412) which drives the die rolls (37) and a plunger pump (32).

2. The apparatus according to claim 1, wherein the film-sheet forming drum is provided with a liquid circulation device (45) that circulates constant temperature liquid through the film-sheet forming drum, said liquid circulation device having a constant temperature liquid pipe (454) and controlling to keep the temperature of the film-sheet forming drum at a constant temperature, and an air blowing device (46) that blows constant-temperature-and-humidity-controlled air toward the outer peripheral surface of the film-sheet forming drum from outside.

3. The apparatus according to claim 1, wherein the die roll is provided with an air blowing device (47) that blows constant-temperature-and-humidity-controlled air toward an outer peripheral surface of the die roll from below.

4. The apparatus according to claim 1, wherein the wedge is provided with a plurality of nozzles (353) corresponding to a group of the capsule pockets of the die rolls, that injects the material towards the capsule pocket group of the die rolls at a time, to charge the film-sheet pockets with the material.

5. The apparatus according to claim 1, wherein the plurality of capsule pockets (372) is arranged in rows and is open on the outer peripheral surface of a die roll (37), and the blade (373) is formed between the respective adjacent capsule pockets 372.

* * * * *

UNITED STATES PATENT AND TRADEMARK OFFICE

CERTIFICATE OF CORRECTION

PATENT NO. : 7,377,760 B2
APPLICATION NO. : 11/560474
DATED : May 27, 2008
INVENTOR(S) : Takayanagi It is certified that error appears in the above-identified patent and that said Letters Patent is hereby corrected as shown below:

Column 5, Line 43, “shape of a capsule pockets” should read -- shape of capsule pockets --

Column 7, Line 37, “alternately rotate reversely” should read -- alternately rotated reversely --

Column 8, Line 44, “maybe” should read -- may be --

Column 10, Line 29, “side is separated” should read -- side are separated --

Signed and Sealed this

Eleventh Day of November, 2008

JON W. DUDAS
*Director of the United States Patent and Trademark Office*